United States Patent [19]

Lourenco

[11] Patent Number: 4,462,545

[45] Date of Patent: Jul. 31, 1984

[54] SPRINKLER DEVICE

[76] Inventor: Antonio Lourenco, 16 Lounsbury Ave., Waterbury, Conn. 06706

[21] Appl. No.: 406,996

[22] Filed: Aug. 10, 1982

[51] Int. Cl.[3] ..... B05B 3/00

[52] U.S. Cl. ..... 239/97; 137/624.14; 239/236; 239/DIG. 1

[58] Field of Search ..... 239/97, 98, 101, 225, 239/230, 236, DIG. 1; 137/624.13, 624.14

[56] References Cited

U.S. PATENT DOCUMENTS

| | | | |
|---|---|---|---|
| 1,855,647 | 4/1932 | Pottenger | 239/DIG. 1 |
| 2,780,488 | 2/1957 | Kennedy | 239/97 |
| 3,093,313 | 6/1963 | Salminen | 239/97 |
| 3,272,437 | 9/1966 | Coson | 239/236 |
| 3,451,623 | 6/1969 | Dibrell | 239/97 |
| 3,528,093 | 9/1970 | Eerkens | 239/DIG. 1 |

FOREIGN PATENT DOCUMENTS

| | | | |
|---|---|---|---|
| 93509 | 1/1959 | Norway | 239/DIG. 1 |

*Primary Examiner*—John J. Love
*Assistant Examiner*—Michael J. Forman
*Attorney, Agent, or Firm*—Lawrence Hager

[57] ABSTRACT

A discrete device attachable to a rotary sprinkler head for varying the water pressure therein to constrain the water distribution to produce a desired irrigation pattern. The sprinkler head attachment-device includes a housing having an intermediate wall partitioning the housing into upper and lower water chambers with an orifice therebetween. A spindle having a cam rotatable with the sprinkler head is mounted within the upper chamber. A cam follower is pivoted into engagement with the cam by means of hydraulic pressure. A valve key portion of the cam follower constricts the flow of water through the orifice in a variable manner controlled by the shape of the cam whereby the desired spray pattern is achieved.

15 Claims, 9 Drawing Figures

SPRINKLER DEVICE

FIELD OF INVENTION

The present invention relates to devices for distributing irrigation water to fields and lawns and, more particularly, to an attachment-device for a rotary type sprinkler head to vary the water pressure whereby a desired precipitation pattern such as, for example, a square is obtained.

BACKGROUND OF THE INVENTION

The water distributing devices exemplified in the prior art typically utilize a rotary sprinkler, whose rotary motor action is derived from the energy of the pressurized water flow, to produce a circular irrigation pattern. However, use of such devices may necessitate the over-lapping of sprinkled areas and the precipitation of undesired areas in order to irrigate a non-circular shaped area.

Some prior art sprinkling devices have been proposed for overcoming the circular irrigation pattern deficiencies of the rotary type sprinklers. These devices have numerous deficiencies such as being sumptuous in component parts, being cumbersome in design, requiring considerable adjustments, are subject to failure or binding of their components such as springs, and are relatively expensive and complex to manufacture.

PRIOR ART STATEMENT

In a number of prior art devices, such as described in U.S. Pat. Nos. 2,780,488 and 2,999,643 issued to William P. Kennedy, the pattern irrigation device appears to include a sprinkler design containing a water motor having reduction gears and a sprinkler head specifically designed as an integral mating part of the device.

Another prior art device described in U.S. Pat. No. 3,884,416 issued to Michael L. King appears to produce a desired irrigation pattern by means of an orifice plate having rectangular passages and a port plate having rectangular ports. The radial reach of the water is varied depending upon the mutual overlap between the radially offset orifices and ports.

Other prior art patents of interest include: U.S. Pat. Nos. 2,962,220; 3,272,437; 3,528,093; 3,960,327; 4,019,686; 4,269,354; 4,277,029; 4,281,793 and Norway Pat. No. 93,509.

The above noted patents are mentioned as being representative of the prior art and other pertinent references may exist. None of these patents are deemed to affect the patentability of the present claimed invention.

In contrast to the prior art, the present invention provides a fluid flow regulator attachment for a rotary sprinkler which utilizes an integral cam follower and valve orifice regulator pivotally mounted and directly responsive to hydraulic pressure for being urged pivotally into engagement with a cam having a shape generally corresponding to that of the desired irrigation pattern. The cam and cam follower and valve orifice regulator are mounted within a housing through which the pressurized fluid flows. The cam is rotatable with the sprinkler head. The relative vertical or longitudinal position of the cam's engagement with the elongate surface of the cam follower may be made variable to effect selective alteration or adjustment to the irrigation distribution pattern, for example, to accommodate different fluid pressure conditions.

SUMMARY OF THE INVENTION

Apparatus for regulating a fluid flow to a rotary sprinkler head comprising:

- a housing having a first and a second internal cavity with an orifice therebetween;
- cam means mounted within said first cavity being rotatable with the rotary sprinkler head;
- cam follower means hydraulically urged into engagement with said cam means and having a member responsive to movements of said cam follower for regulating or constraining the passageway of said orifice.

Accordingly, it is an object of the present invention to provide apparatus for regulating fluid flow through an orifice.

Another object of the present invention is to provide relatively inexpensive apparatus for improved irrigation of odd shaped surface areas.

Another object of the present invention is to provide apparatus designed to sell at the lowest price while providing a high level of performance, reliability, efficiency and constructural simplicity.

It is yet another object of the invention to teach the construction of a device for attachment to a rotary sprinkler head for constraining the water distribution thereof to produce a desired irrigation pattern.

Another object of the invention is to provide a discrete adaptor which is economical to manufacture, provides ease of maintenance and is readily attachable to rotary sprinklers of standard design.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENT

Figure 1:
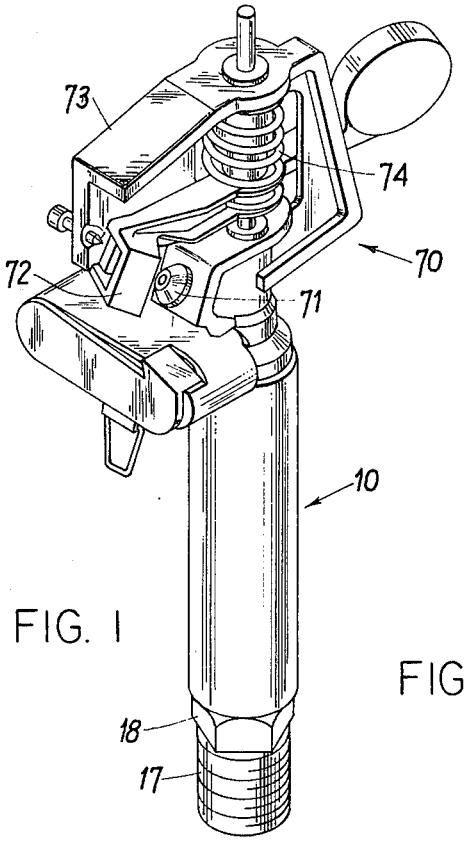
FIG. 1 is a perspective view of the sprinkler adaptor attached to a rotary sprinkler head.
Figure 2:
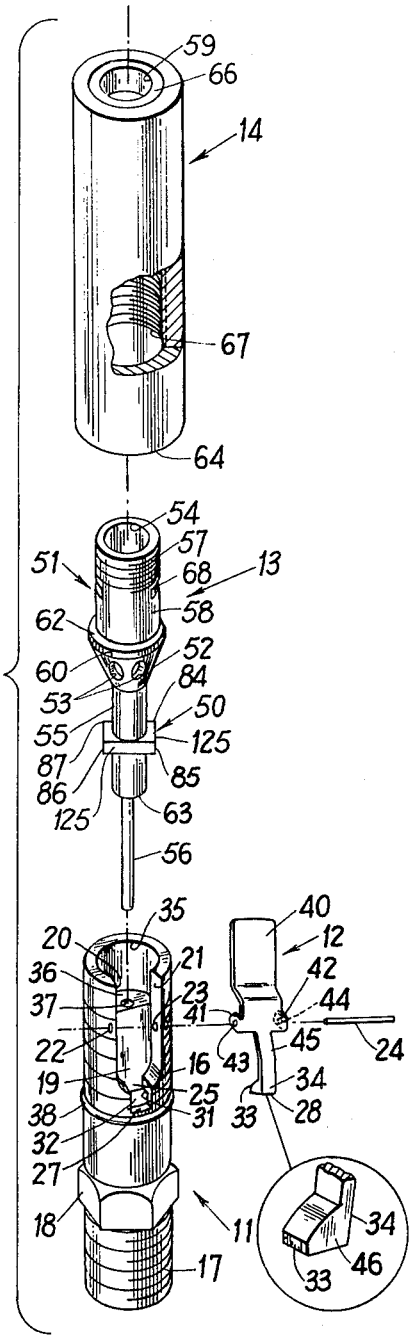
FIG. 2 is an exploded view of the preferred embodiment of the present invention.
Figure 3:
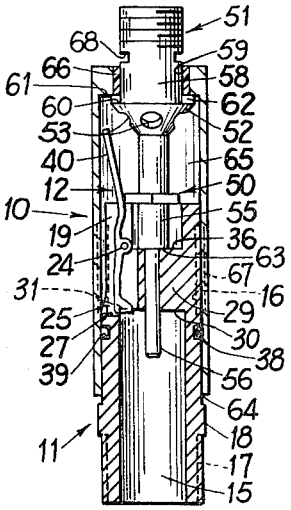
FIG. 3 is a partial vertical section through the body with the cam spindle and pivoted cam follower shown mounted thereto.

Referring to the drawings, particularly FIGS. 1–3, there is shown an irrigation pattern adaptor or regulator 10 constructed in accordance with the invention to have a simple water flow/pressure regulator valve generally comprising a body or water channel section 11, a cam follower 12, a cam spindle 13 and an outer water jacket 14. The constituent parts of the adaptor 10 may be formed, for example, of any suitable metal or plastic or combination thereof.

The water channel 11 comprises a generally cylindrical column or tubular member having a central bore 15. The upper and lower ends of the water channel 11 have external pipe threads 16 and 17 to permit the water channel 11 to be connected to the outer water jacket 14 and a water conduit, respectively, such as a lawn hose (not shown). Integral flat portions 18 may be provided to facilitate connecting the threaded female end of the conduit to the lower threaded male end of the water channel 11.

The upper end of the water channel 11 is provided with a cutout or alcove 19 adapted to pivotally receive a paddle shaped cam follower 12. The laterally disposed walls 20 and 21 of alcove 19 have aligned holes 22 and 23, respectively, for receiving the pivot pin 24 whereby the cam follower 12 is pivotally mounted within alcove 19. The lower portion 25 of alcove 19 is rectangularly shaped to receive a contoured valve orifice regulator key member 26 extension of the cam follower 12. The bottom ledge or wall 27 of alcove 19 extends slightly below the bottom surface 28 of key member 26 to receive same with a pendulum like motion of key member 26 (such pendulum motion being more fully described hereinafter).

The central bore 15 of water channel 11 extends upwardly to a partition wall 29 having a bottom wall surface 30 defining the upper wall of the central bore 15. The bottom surface 30 of wall 29 generally lies above the ledge 27 of the rectangularly shaped key receiving portion 25 of alcove 19 a distance predetermined to form side wall steps 31 in a portion of partition wall 29 relative to ledge 27. The side walls forming steps 31 define a valve orifice or window 32 through which fluid or water can flow into alcove 19. As will be discussed more fully hereinafter, the greater this step effect, the greater the surface of the toe portion 33 that will extend downwardly into central bore or first fluid chamber 15 and, thereby, increasing the hydraulic pressure of the pressurized fluid or water in bore 15 on the valve key 26 urging it outwardly into alcove 19, whereby an enlargement of the fluid passageway through orifice 32 may be effected.

The upper end of water channel 11 contains a second bore or alcove 35 defining a ledge portion 36 having a central spindle mounting hole 37 therein.

An O-ring or gasket 38 is provided in a circumferential groove 39 formed in an intermediate portion of the water channel section 11. Gasket 38 serves to provide a fluid seal between body member 11 and the outer water jacket 14, with the adaptor 11 being fully assembled.

As noted above, the cam follower 12 has a paddle like shape including an upper paddle member 40 having an elongate, flat, generally rectangular shape, pivot mounting members 41 and 42 each having a pivot pin mounting hole 43 and 44, respectively, an arm member 45 and a valve regulator or orifice key 26. The valve orifice regulator 26 or shoe end of cam follower 12 contains a toe and heel portion 33 and 34 and flat side walls 46. The upper paddle member 40 has a flat cam engaging portion having a width approximately equal to or greater than the dimension of the straight side walls of cam 50.

The cam follower 12 is pivotally mounted within alcove 19 by means of pivot pin 24 being inserted into the pivot mouting holes 22, 23, 43 and 44. In the mounted position with valve regulator key 26 projecting downwardly into central bore 15, the side walls or flat portions 46 of key 26 lie in juxtaposition with the side walls of alcove 19 and step 31, with the heel member 34 being in juxtaposition with the bottom surface 27 of the rectangular cutout portion of alcove 19. The toe portion 33 includes a flat section that extends downwardly generally in vertical or sloped disposition within the central bore 15, with the valve key 26 being pivoted inwardly as shown in FIG. 3, and, therefore, is subject to the (hydraulic) pressure environment created, for example, by the pressurized water provided into central bore 15 from a lawn hose (not shown). In the mounted position shown in FIG. 3, the paddle member 40 extends upwardly for engaging a cam 50.

The cam spindle 13 generally comprises a cylindrical column having a tubular head 51, an inverted bell shaped member 52 with ports 53 into the central bore 54 of head 51, an intermediate shaft 55 having an integrally formed cam 50, and a downwardly projecting mounting pin or axle rod 56. The head 51 includes external pipe threads 57 for mating with the internal pipe threads (not shown) of the sprinkler 70. Flat portions 68 may be provided to receive a tool such as a wrench (not shown) to facilitate connection with the sprinkler 70. A smooth round lower portion 58 is dimensioned to rotatably fit within the upper opening 59 of the water jacket 14. The bell member 52 includes a circumferential ledge 60 that extends beyond walls 61 forming opening 59. A washer or gasket 62 may be mounted on ledge 60. The washer 62 may be formed of any suitable material to enable rotary motion of the cam spindle 13 while substantially providing a water seal with the walls 61 of opening 59. A cam 50 having the shape of the desired irrigation pattern is provided on shaft 55. In accordance with the preferred embodiment of the invention, a generally square cam 50 is integrally formed about shaft 55 and is rotatable therewith. The shaft 55 has a bottom ledge 63 which abuts ledge 36 to define the lower axle position of the cam spindle 13 relative to the cam follower 12 and water channel member 11. The axle rod 56 extends downwardly about the axis of the cam spindle 13 and is received within mounting hole 37 of the water channel member 11, whereby the cam spindle 13 is axially and rotatably mounted on or to the water channel member 11.

The outer water jacket 14 is of tubular construction open at one end 64 for receiving portions of the cam spindle 13 and water channel member 11 within its central bore or cavity 65. As noted above, the cam spindle head 51 is dimensioned to project upwardly through opening 59 formed by walls 61. A plastic or phenolic coating or ring 66 may be provided about opening 59, to reduce metal to metal contact, when a metal such as brass is utilized to form the cam spindle 13 and water jacket 14 components. The vertical disposition or elevation of the outer water jacket 14 relative to the water channel section 11 is adjustable by means of the mating pipe threads 16 and 67.

The irrigation pattern adaptor or regulator 10 is readily connected to the female connector of a rotary sprinkler head 70 by means of threads 57.

The rotary sprinkler head 70 has a jet or nozzle 71 for distributing the water entering the internal passages of the head through bore 54 of the cam spindle 13. As water under pressure is jetted from nozzle 71 it impacts the cantilevered arm 72 deflecting it away from frame member 73 and, thereby, winding up spring 74. The spring tension so generated urges the arm 72 toward frame member 73, where the water jet pushes the arm outwardly again. This jerky motion is indefinitely repeated whereby the water jet pressure is utilized to provide rotary motion to the sprinkler head 70.

Figure 5:
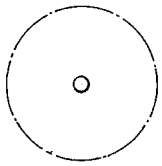
FIG. 5 is a map of the surface irrigated by standard rotary type sprinkler heads.

The rotary sprinkler head 70 is of conventional design similar to prior art impact-driven sprinklers whose irrigation pattern is a circle (as shown in FIG. 5), delimited by the radius to which water is delivered from nozzle 71.

OPERATION

With the irrigation pattern adaptor 10 connected to the rotary sprinkler head 70 (shown in FIG. 1) and vertically supported by conventional means (not shown), the water flows upwardly under pressure from the conduit or hose (not shown) into the central bore or first water chamber 15. The water continues to flow upwardly through orifice 32, alcove 19 into chamber 65 (formed between the inner walls of outer water jacket 14 and water channel 11), through ports 53 and bore 54 into the sprinkler head 70, where it is jetted from nozzle 71. As noted above, the water jet causes the sprinkler head 70 to rotate, which results in the rotation of cam spindle 13.

The hydraulic pressure within the first chamber 15 and/or the water flow through orifice 32 is utilized to maintain a hydraulic force or pressure on the regulator key 26 urging it in the direction of the rectangular cutout portion 25 of alcove 19. This outwardly directed pressure on regulator key 26 is pivotally translated into an inwardly directed motion of the paddle shaped end 40 of the cam follower 12 urging it into engagement with cam 50.

Figure 4:
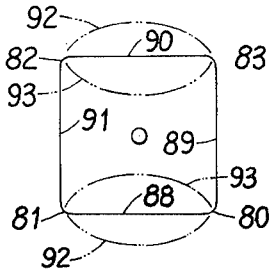
FIG. 4 is a map of the surface irrigated by the assembly shown in FIG. 1.

Now, if it is assumed that the flat paddle member 40 of the cam follower 12 aligns or abuts with a straight wall portion 125 of cam 50 during rotation of cam spindle 13, the valve regulator key 26 is pivoted outwardly into the corresponding rectangular cutout portion 25 of alcove 19. Thus with the paddle member 40 being disposed into engagement with one of the straight wall portions 125, the valve regulator key 26 is pivoted to the outward position whereby the water flow rate through orifice 32 is increased. The increased flow rate and pressure within the second chamber 65 of the adaptor 10 is provided to the sprinkler head 71, which, in turn, jets a water stream to a correspondingly further distance delimitating a respective corner 80, 81, 82 and 83 of the square irrigation pattern depicted in solid outline in FIG. 4.

As the spindle 13 is rotated by rotation of sprinkler head 10, a corner portion 84, 85, 86 and 87 of the generally square cam 50 engages the flat paddle member 40 of the cam follower 12 urging or camming it outwardly against the hydraulic pressure or force being maintained on valve regulator key 26. The outward disposition of paddle member 40 pivots the valve regulator key 26 inwardly further within orifice 32, whereby the flow rate into the second chamber 65 and, therefore, water pressure at nozzle 71 are correspondingly reduced. This reduced flow rate and water pressure continues during the period in which a cam corner portion 84, 85, 86 and 87 sweepingly engages the flat paddle member 40. The pivot position of the cam follower 12 will vary slightly during each corner portion's 84, 85, 86 and 87 sliding engagement across the flat surface of the paddle member 40. Each corner member 84, 85, 86 and 87 is hydraulically held in sliding contact with the paddle member 40 during an angle-of-revolution of the sprinkler head 10, whereby the respective straight lined irrigation portions 88, 89, 90 and 91 of a square irrigation pattern (see FIG. 4) are delimitated.

As is often the case, the water pressure from a conduit or hose may vary from location to location depending, for example, on the pump or pressure setting in that community. A water pressure greater than the nominal pressure for which the adaptor 10 may be designed may result in an outward bowing 92 of the square irrigation pattern (shown in phantom outline in FIG. 4). On the other hand, a lower than expected nominal pressure may result in a pincushion shaped effect wherein the straight edges of the square irrigation pattern are caused to bow inwardly 93. In accordance with one feature of the preferred embodiment of the invention, an inward or outward bowing may be reduced or substantially eliminated by varying the height or vertical position at which the cam 50 engages or sweeps across the flat paddle member 40. For example, assuming a low water pressure is being provided from the garden hose with the cam spindle 13 disposed as shown in solid line in FIG. 3, an inward bowing may result along the otherwise straight edges 88, 89, 90 and 91 of the illustrated square irrigation pattern (see FIG. 4). By elevating the cam spindle 13, the cam 50 engages the paddle member 40 at a higher position, i.e., further from the pivot point about pin 24. This alters the disposition and/or extent of travel outwardly and inwardly of the valve regulator key 26 within or into orifice 32, whereby its restrictive effect or action on the flow of water from the first to second chambers 15, 65 through orifice 32 is correspondingly reduced during each revolution of the cam spindle 13. In this manner, the flow rate and/or water pressure at the sprinkler head nozzle 71 is altered to obtain or produce the desired substantially square irrigation pattern.

The cam spindle 13 is axially movably mounted by means of shaft 56. The hydraulic pressure against, for example, the cam 50 and bell member 52 urges the cam spindle 13 in an upward direction with water flowing through the adaptor 10. This upward force maintains the ledge portion 60 of the bell section 52 hydraulically biased or urged against the bottom wall 61 of the outer water jacket 14, with gasket 62 interposed therebetween.

With rotation of the outer water jacket 14, screw like threads 16 and 67 cause a shift or change in the height or vertical disposition of the outer water jacket 14 relative to the water channel section 11. In this manner, the vertical position of the cam 50 relative to the paddle member 40 may be readily adjusted.

From the above it should now be appreciated that the cam follower member 12 functions as a cam follower which is hydraulically urged or biased into engagement with the cam 50, and includes a valve regulator key 26 which constricts the water passageway of valve orifice 32 in response to the shape of the cam 50. The shape and/or slope of the toe portion 33 of the valve regulator key 26 and/or the depth into which the regulator key 26 projects downwardly within the first chamber 15 may be designed to effect a predetermined hydraulic force for pivoting the cam follower 40 into engagement with the cam 50.

Figure 6:
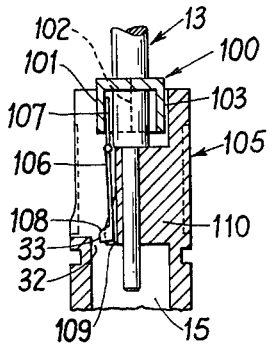
FIG. 6 is a partial, vertical section of the body portion and cam spindle with a pivoted cam follower of an alternative embodiment of the sprinkler adaptor shown in FIG. 2.
Figure 7:
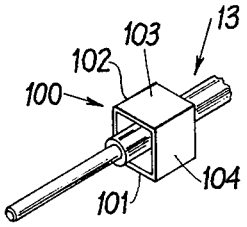
FIG. 7 is a partial bottom perspective view of the cam spindle shown in FIG. 6.

Referring now to FIGS. 6 and 7, a first alternative embodiment of the cam, cam follower and channel section shown in FIG. 1 are illustrated. All other components and operation remain basically the same. The cam 100 comprises a square or rectangular shaped box like projection of the cam spindle 13 having side walls 101, 102, 103 and 104 extending downwardly in the direction of the water channel section 105. The cam follower 106 includes a rod or shaft like follower portion 107 which is pivoted into contact with the inside wall surfaces of side walls 101, 102, 103 and 104 with rotation of the cam spindle 13. The valve regulator key 108 is urged inwardly toward or into an alcove 109 formed in partition wall 110 under the influence of the hydraulic force or pressure of the water within the first chamber 15 or through orifice 32 on the toe portion 33 of the valve regulator key 108. As the cam spindle 13 and cam 100 rotate, the walls, 101, 102, 103 and 104 cause inward and outward movement to rod 107 resulting in the pivoting motion of the valve regulator key 108.

Figure 8:
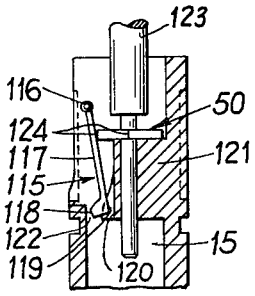
FIG. 8 is a partial, vertical section of the body portion and cam spindle with a pivoted cam follower of a second embodiment of the sprinkler adaptor shown in FIG. 2.

Referring to FIG. 8, a second contemplated alternative embodiment of the cam spindle, cam follower and water channel section are depicted. All other components and/or functions generally remain the same as discussed above. The cam follower 115 is pivotally supported at the upper end 116 and includes an intermediate flat or paddle like member 117 and a lower end having a valve regulator key 118. The heel portion 119 of the valve regulator key 118 is suspended juxtaposed to the surfaces of and slightly within alcove 120 which is formed within partition wall 121. The toe and body portion of the valve regulator key 118 are dimensioned for being disposed within or partially blocking the valve orifice 122. The cam 50 is disposed on the spindle 123 for making sliding contact with a flat portion of the cam follower 117. As the cam 50 is rotated with rotation of the rotary sprinkler head 70, its corners or outward projecting portions 124 cam or urge the cam follower 115 outwardly in a direction away from alcove 120, whereby the valve regulator key 118 is disposed further with orifice 122 restricting flow to the sprinkler head 70. With the flat surface portions of the cam 50 being rotated into alignment with the cam follower 115, the valve regulator key 118 is hydraulically urged further within alcove 120, whereby the flow through orifice 122 is increased. The water channel section is designed to dispose the cam 50 in vertical alignment with the flat portion 117 of the cam follower 115 and to include a valve regulator key alcove 120.

Figure 9:
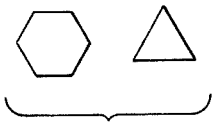
FIG. 9 is a top view of alternative shaped cams.

With reference now to FIG. 9, several possible cam configurations are illustrated by way of example only.

While there has been shown what is considered to be the preferred embodiment and several alternative embodiments of the invention, it is desired to secure in the appended claims all modifications as fall within the true spirit and scope of the invention.

I claim:

1. Apparatus readily attachable between a rotary sprinkler and a fluid conduit for regulating the flow to the sprinkler, comprising:

a housing having a first and a second internal chamber with a fluid passageway therebetween, and having wall portions forming a first and a second fluid port each extending into a respective one of said first and second internal chambers and being connectable with a respective fluid port member of the sprinkler and the conduit;

cam means having irrigation pattern contour surfaces rotatably mounted within said housing, said cam means being rotatable with the sprinkler;

cam follower means mounted within said housing and having a substantially flat portion for engaging said cam means whereby disposition of said cam follower means being responsive to the surface contours of said cam means, said cam follower means having a member being contoured and disposed for being fluid impacted whereby said flat portion being hydraulically pressured into engagement with said cam means; and regulator means responsive to the dispositions of said cam follower means for variably constricting said fluid passageway.

2. Apparatus as in claim 1, wherein:

the cam means has wall portions generally forming a square shaped cam; and the flat portion of said cam follower means has a width approximately equal to or greater than the length of said wall portions.

3. Apparatus as in claim 1, wherein:

the cam means is axially moveably mounted for being disposed relative to the longitudinal orientation of the cam follower means to enable selectively the sliding engagement of the cam means across different longitudinal cross sectional width portions of the flat portion of the cam follower means.

4. Apparatus as in claim 3, wherein:

the cam means is integrally formed on an axially and rotatably moveably mounted spindle having a head portion connectable to the sprinkler, whereby rotational and axial disposition of said sprinkler is transmitted to the cam means.

5. Apparatus for regulating a fluid flow, comprising:

a housing having an internal cavity and a first and a second fluid port extending into said cavity;

cam means having contoured surface portions and rotatably mounted within said cavity;

means pivotally mounted within said cavity integrally formed to have a cam follower portion and a passageway restricting portion, said passageway restricting portion being contoured for being hydraulically actuatable for pivoting the cam follower portion into engagement with said cam means, said cam follower portion being responsive to the surface contours of said cam means for pivoting the passageway restricting portion whereby said first fluid port is restricted.

6. Apparatus for regulating a fluid flow to a rotary sprinkler head having an inlet fluid port, comprising:

a housing having an internal cavity and a first and a second fluid port extending into said cavity, said second fluid port being generally alignable with the inlet fluid port of the sprinkler head to permit fluid flow therebetween;

cam means having contoured surface portions and mounted within said cavity for being rotatable with the rotary sprinkler head; and means pivotally mounted within said cavity integrally formed to have a cam follower portion and a passageway constraining portion, said passageway constraining portion being contoured for being fluid impacted for effecting a pivoting of the cam follower portion causing engagement with said cam means, said cam follower portion being responsive to the surface contours of said cam means for pivotally disposing the passageway constraining portion for variably constraining the first fluid port.

7. Apparatus as in claim 6, wherein:

the means comprising the cam follower portion and passageway constraining portion has a paddle like shape with a generally flat elongate cam follower portion, an intermediate pivot mounting bracket, and an arm portion having an end defining the passageway constraining portion.

8. An adaptor device connectable between an inlet port of a rotary sprinkler head and an outlet port of a fluid conduit for regulating the flow of fluid therebetween, comprising:

a body member including a central bore extending upwardly from a first open end to a partition wall, said first open end being connectable with the fluid conduit for receiving a pressurized fluid therefrom, said partition wall having wall portions forming an alcove, said wall portions having laterally aligned pivot holes, said partition wall having a valve orifice extending from said central bore into said alcove and a spindle mounting hole;

a pivot member including a first cam follower end portion, an intermediate portion having a pivot hole, a second end portion contoured to form a valve orifice regulator member and a hydraulic actuator member;

a pivot pin contoured for being received within the respective pivot holes in the body and pivot members whereby said pivot member is pivotally mountable within said alcove with said valve orifice regulator member being pivotally disposable to obstruct said valve orifice and with said hydraulic actuator member being pivotally disposable within the central bore of said body member;

an elongate cam spindle including a tubular shaped head portion with an internal bore, a lower wall portion having a fluid port extending into the internal bore, a circumferential ledge extending about said head portion, an intermediate shaft portion having an integrally formed irrigation pattern shaped cam, and a mounting rod contoured for being axially and rotatably moveably mounted within the spindle mounting hole in said body member; and an outer fluid jacket having a chamber extending upwardly from an open end portion to an upper wall member having a spindle head receiving hole therein, said outer fluid jacket being connectable about said open end portion with said body member such that said cam spindle extends upwardly within the chamber with the spindle head portion projecting through said spindle head receiving hole for being connectable with the sprinkler head whereby said circumferential ledge is in juxtaposition with said upper wall member and said first cam follower end portion and said cam are engageably disposed within said chamber and with the fluid port within the spindle head extending into said chamber.

9. An adaptor device as in claim 8, wherein:

the irrigation pattern shaped cam has a generally square configuration with four camming wall portions having a predetermined length; and the first cam follower end portion has a flat portion having a width approximately equal to or greater than the length of a camming wall portion forming a side of the square cam.

10. An adaptor device as in claim 9, wherein:

the body member and the outer fluid jacket have mating pipe like threads for enabling selective adjustable elevation of the outer fluid jacket relative to the body member whereby the irrigation pattern shaped cam is caused to engage a different longitudinal surface across the flat portion of said first cam follower end portion.

11. An adaptor device as in claim 8, wherein:

the pivot member has a paddle like shape having a flat generally rectangular cam follower portion and a contoured valve orifice regulator member end, said valve orifice regulator member end being disposable substantially within the fluid passageway formed by said valve orifice to constrict fluid flow therethrough, said hydraulic actuator member extending within the central bore of said body member to a predetermined depth for effecting a desired hydraulic pressure thereon causing pivoting of the pivot member about the pivot pin.

12. An adaptor device as in claim 8, wherein:

the irrigation pattern shaped cam comprises a box like member having an open end formed by four downwardly extending walls joining to form four corner portions; and the first cam follower end portion comprises a rod shaped member contoured for engaging the inside wall surfaces of the box like member.

13. An adaptor device as in claim 8, including:

a gasket member interposed between the circumferential ledge of said cam spindle and the upper wall member of said outer fluid jacket;

an o-ring fluid seal interposed between said body member and said outer fluid jacket; and a washer interposed between the spindle head portion and the wall member forming the spindle head receiving hole of said outer fluid jacket.

14. A device readily connectable between an inlet port of a rotary sprinkler head and an outlet port of a water hose for constricting the flow and/or pressure of water within the rotary sprinkler head for altering its irrigation water distribution, comprising:

a housing having a first and a second water chamber with a partition wall interposed therebetween, said partition wall having a valve orifice extending into said first and second water chambers, said housing having a water inlet and a water outlet port each extending into a respective first and second water chamber and connectable with a respective inlet port of the sprinkler head and the outlet port of the water hose;

cam means having contoured surfaces generally corresponding in shape with a desired irrigation distribution pattern and being rotatably mounted within one of said first and second water chambers;

unitary means pivotally mounted within one of said first and second water chambers and having a cam follower portion and a valve orifice regulator portion, said unitary means having a portion engagable with water for hydraulically pivoting the cam follower portion into engagement with said cam means, said cam follower portion being responsive to the surface contours of said cam means for pivotally disposing the valve orifice regulator portion for variably regulating flow through said valve orifice in response to movements of the cam follower portion.

15. A device as in claim 14, wherein:

the unitary means comprises a member having a first end pivotally mounted, an intermediate cam follower portion engagable with said cam means, and a second end disposed in juxtaposition with said partition wall about the valve orifice and contoured to function both as the valve orifice regulator and as an actuator being hydraulically urged for disposing said cam follower portion inwardly into engagement with said cam means.

* * * * *